US009487327B2

(12) United States Patent
Schmid

(10) Patent No.: US 9,487,327 B2
(45) **Date of Patent: *Nov. 8, 2016**

(54) BEVERAGE CAN

(71) Applicant: SEIBERSDORF LABOR GMBH, Seibersdorf (AT)

(72) Inventor: Gernot Schmid, Bromberg (AT)

(73) Assignee: Siebersdorf Labor GmbH, Siebersdorf (AT)

( * ) Notice: Subject to any disclaimer, the term of this patent is extended or adjusted under 35 U.S.C. 154(b) by 0 days.

This patent is subject to a terminal disclaimer.

(21) Appl. No.: 14/778,674

(22) PCT Filed: Mar. 7, 2014

(86) PCT No.: PCT/AT2014/050059

§ 371 (c)(1),
(2) Date: Sep. 21, 2015

(87) PCT Pub. No.: WO2014/146155

PCT Pub. Date: Sep. 25, 2014

(65) Prior Publication Data

US 2016/0039564 A1 Feb. 11, 2016

(30) Foreign Application Priority Data

Mar. 20, 2013 (AT) ..... A 190/2013

(51) Int. Cl.
*B65D 17/00* (2006.01)
*B65D 51/24* (2006.01)

(52) U.S. Cl.
CPC ..... *B65D 17/165* (2013.01); *B65D 51/245* (2013.01); *B65D 2203/10* (2013.01); *B65D 2517/0014* (2013.01); *B65D 2517/0053* (2013.01)

(58) Field of Classification Search
CPC .. B65D 2203/10; B65D 17/02; B65D 17/00; G06K 19/07327; G06K 19/041
USPC ..... 220/266, 265; 235/492; 340/10.1, 572.1
See application file for complete search history.

(56) References Cited

U.S. PATENT DOCUMENTS 8,570,153 B2 10/2013 Sotobayashi et al.
9,170,085 B2 * 10/2015 Bammer ..... G01D 5/145

(Continued)

FOREIGN PATENT DOCUMENTS

DE 10344270 A1 4/2005
JP 2010001074 A 1/2010

(Continued)

*Primary Examiner* — King M Chu
(74) *Attorney, Agent, or Firm* — Laurence A. Greenberg; Werner H. Stemer; Ralph E. Locher

(57) ABSTRACT

A can includes a body, a sealing area on a wall delimited by a breaking edge, an opening element which in an initial position abuts the wall and is connected to the wall by a connecting element of the opening element. Pivoting the opening element into an open position tears the sealing area along the breaking edge and forms an emptying opening in a region delimited by the breaking edge. The opening element has a carrier body of electrically and/or magnetically insulating material, the opening element carries an antenna on or in the carrier body and a transponder chip connected to the antenna. An electric connection line electrically conductively interconnects and short-circuits terminals of the antenna in the initial position. The electric connection line is irreversibly interrupted and activates the antenna when opening the can by pivoting the opening element from the initial to the open position.

23 Claims, 8 Drawing Sheets

(56) References Cited

U.S. PATENT DOCUMENTS

2008/0055089 A1* 3/2008 Gustafsson ..... G06K 19/07749 340/572.1
2010/0219252 A1* 9/2010 Kikuchi ..... G06K 19/07749 235/488
2011/0102150 A1 5/2011 Sotobayashi et al.
2013/0307683 A1* 11/2013 Greenberg ..... A47G 19/2227 340/539.1
2015/0045727 A1* 2/2015 Bammer ..... A61M 5/31525 604/67
2015/0129663 A1* 5/2015 Schmid ..... B65D 17/165 235/492
2016/0039564 A1* 2/2016 Schmid ..... B65D 17/165 220/215

FOREIGN PATENT DOCUMENTS

JP 2010004523 A 1/2010
WO 2012102759 A1 8/2012

* cited by examiner

FIG. 9
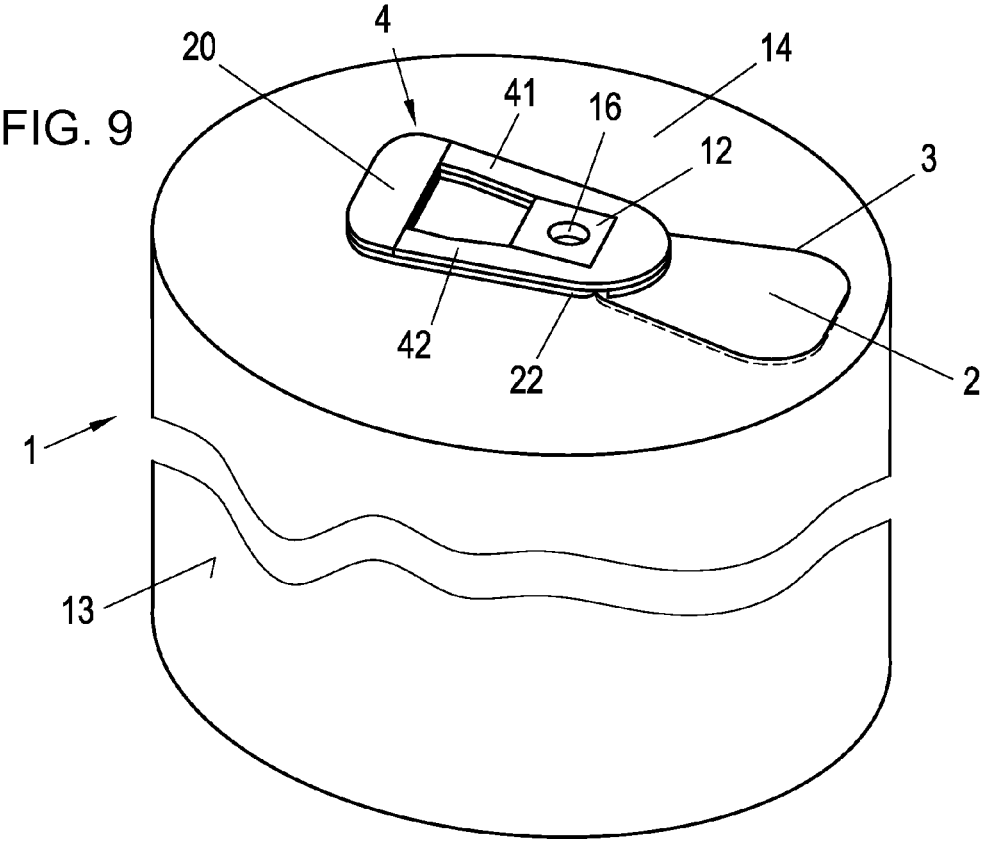
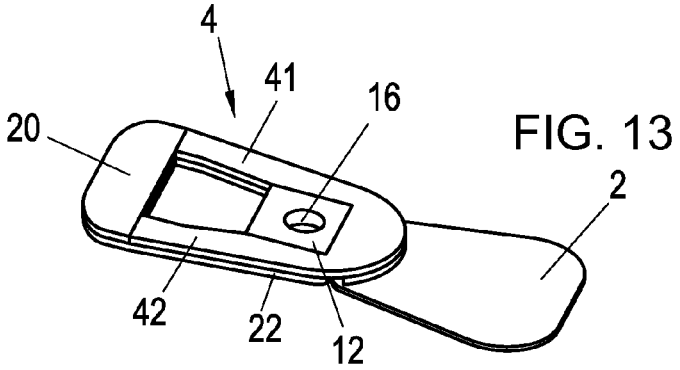
FIG. 13
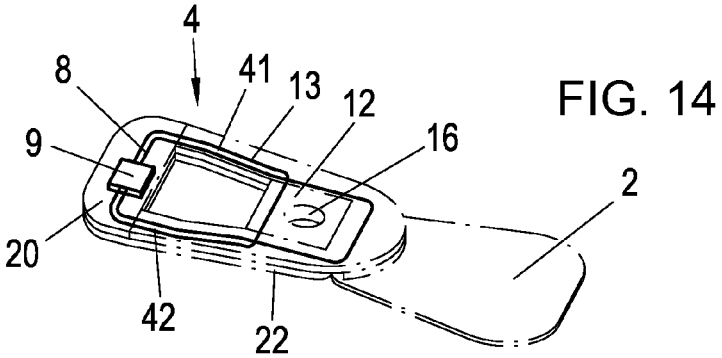
FIG. 14

BEVERAGE CAN

BACKGROUND OF THE INVENTION

Field of the Invention

The invention relates to a can comprising a body, in particular of aluminum, a sealing area at least partially demarcated on a front wall of the can by a predetermined breaking edge, an opening element which in its initial position rests at least partially against the front wall of the can and is connected to the front wall at least at one point via a connecting element, which is formed as part of the opening element, and is in particular connected to the front wall, wherein when the opening element is pivoted with regard to the can from the initial position to an open position, the sealing area rips along the predetermined breaking edge and an opening for emptying the content of the can is formed in the intermediate area demarcated by the predetermined breaking edge.

A plurality of beverage cans is known from the state of the art, which can be opened by means of a one-time seal, where a sealing area is broken out of the body of the can when it is opened so that the content of the can may be emptied from the can.

According to the state of the art it is also possible to dispose RFID/NFC antennas and RFID/NFC transponders on objects, in particular cans, in order to transmit data stored in the transponder via an external data communication device to the external communication device.

However, the state of the art does not know any possibility to transmit data from a container to an external data communication device only when a one-time seal on the container has been opened. Such a device could, for example, be used to make certain information stored in the transponder only available to the person who has purchased the respective can or the respective container. Typically, such a can may advantageously be used for prize draws where it is required that the respective participant has bought or opened the can.

BRIEF SUMMARY OF THE INVENTION

It is thus the object of the invention to provide a can with which data from a transponder disposed on the can are only transmittable to an external data communication device when the respective can has been opened and/or where data can only be stored with an external data communication device on a transponder disposed on the can when the respective can has been opened.

The invention solves this problem of the can of the type mentioned at the beginning with the following features: According to the invention it is provided for a can comprising a body, in particular of aluminum, wherein a sealing area is at least partly demarcated on a front wall of the can by a predetermined braking edge and wherein the can has an opening element, which in its initial position rests at least partly, in particular flatly, against the front wall of the can and is connected to the front wall at least at one location by means of a connecting element, which is formed as part of the opening element and is in particular connected to the front wall, and wherein, when the opening element is pivoted with regard to the can from the initial position to an open position, the sealing area comes off along the predetermined breaking edge and an opening for emptying the content of the can is formed in the intermediate area demarcated by the predetermined breaking edge, that the opening element has a carrier body of an electrically and/or magnetically insulating material or consists thereof, that the opening element carries an antenna disposed on or within the carrier body as well as a transponder chip connected to the antenna, that an electric connection line is provided, which in the initial position electrically connects and short-circuits the two terminals of the antenna, and that the electric connection line is arranged so that it is irreversibly interrupted when the can is opened by pivoting the opening element from the initial position to the open position, which activates the antenna.

This design guarantees that data communication between the transponder disposed on the can and an external data communication device is only possible when the can has been opened. In any case, data communication is impossible as long as the opening element is in its initial position and the can has not been opened.

A particularly simple design, which provides for a simple ripping of the connection line, provides that the electric connection line is arranged partly within or on the connection element and partly within or on the opening element, and the connection line rips when the opening element is pivoted with regard to the connection element.

In order to allow simple ripping, it may be provided that the electric connection line has a predetermined breaking point in at least an intermediate area between the connecting element and the opening element, which rips when the opening element is pivoted with regard to the connecting element.

A particularly simple design of an inventive can provides that the antenna and the transponder chip are arranged on a common foil, in particular a common adhesive label, which is arranged on the opening element, in particular is adhered to the opening element.

In order to allow for simple separation of the connection line, it may be provided that the electric connection line is arranged within or on the foil and that the connection line and the foil are partly arranged on the opening element and partly on the connecting element.

An advantageous track of the connection line as well as a simple integration of the connection line into the opening element provides that the connecting element and/or the opening element have a partially electrically conducting body and that the connection line is formed through the electrically conducting part of the body of the connecting element and/or the opening element.

An advantageous mount of the connecting element with the front wall of the can provides that the connecting element is connected with the front wall of the can by providing the connecting element flatly and lies or runs firmly in a plane parallel with the front wall and is connected therewith, wherein the connecting element is rotatable, in particular around an axis perpendicular to the plane of the front wall.

In order to additionally effectively avoid shielding or displacement of electromagnetic waves targeted at the antenna in the open position, it may be provided that the conductivity of the carrier material of the opening element is lower than 1 S/m at a transmission frequency of the transponder chip in the range between 100 kHz and 1000 MHz, in particular in the range of 120 to 135 kHz, in the range of 13 to 14 MHz, or in the range of 860 to 910 MHz, and/or that the magnetic permeability of the opening element is lower than $(1+2.2*10^{-5})*4*\pi*10^{-7}$ Vs/Am.

One embodiment of the invention that is particularly simple to manufacture provides that the sealing area and the predetermined breaking edge are formed at a front wall of the can.

An arrangement that allows for an advantageous pivoting of the opening element provides that the opening element is connected to the can via a rivet, wherein the opening element has, in its initial position, a pressing area for pressing in the sealing area resting against the sealing area.

In order to enable easy opening of the can, it may be provided that the opening element has an actuation area opposite to the pressing area, wherein the pressing area and the actuation area are separated from each other by the rivet and together act like a two-armed lever, in particular pivoted by the rivet (6).

A particularly simple mechanical design allowing good pivoting of the opening element with regard to the can provides that the opening element has a connecting element pivotable with regard to its body, which is connected to the front wall of the can via the rivet.

A particularly simple positioning of the transponder can be reached by arranging the transponder chip in the initial position in an area of the opening element that rests against the sealing area.

Particularly advantageous for the use of transmission frequencies of 120-135 kHz or 10-15 MHz is that the antenna is annular and is in particular arranged within a notch along the circumferential edge of the opening element.

A design that can be manufactured particularly advantageously provides that the opening element comprises two parts and has a basic part pivoting at the front wall as well as an antenna part connected to the basic part and having an electrically non-conducting body, wherein the transponder chip and the antenna are arranged in, in particular cast within, the antenna part, and wherein the basic part has at least one extension, in particular two extensions, which is connected to the antenna part and in particular rests against the same.

Here it may be advantageously provided that the antenna part has a housing part and an annular extension, wherein the antenna runs at least partly within the annular extension.

An advantageously simple design of the opening element provides that the housing part has at least one locking recess, in particular two locking recesses, into which the end of the extension, in particular both ends of the extensions, of the basic part engage, in particular are locked into place, and/or wherein the extension or the extensions of the basic part rest against the antenna part.

In order to enable safe activation of the transponder chip it may be provided that the antenna part has a bridge in the area of the annular extension, which connects a first part of the annular extension with a second part of the annular extension and forms two recesses, wherein one of the recesses receives the rivet and the bridge is, in the initial position, arranged below the connecting part and rips when the opening element is actuated.

BRIEF DESCRIPTION OF THE SEVERAL VIEWS OF THE DRAWING

A preferred embodiment of the invention will be shown in further detail by means of the following drawings.

FIG. 9 shows a fourth embodiment of the invention in the initial position.

FIG. 13 shows the opening element of the third embodiment of the invention in an oblique view.

FIG. 14 shows the opening element of the third embodiment of the invention in an oblique view, wherein the body of the opening element is shown transparent.

DESCRIPTION OF THE INVENTION

Figure 1:
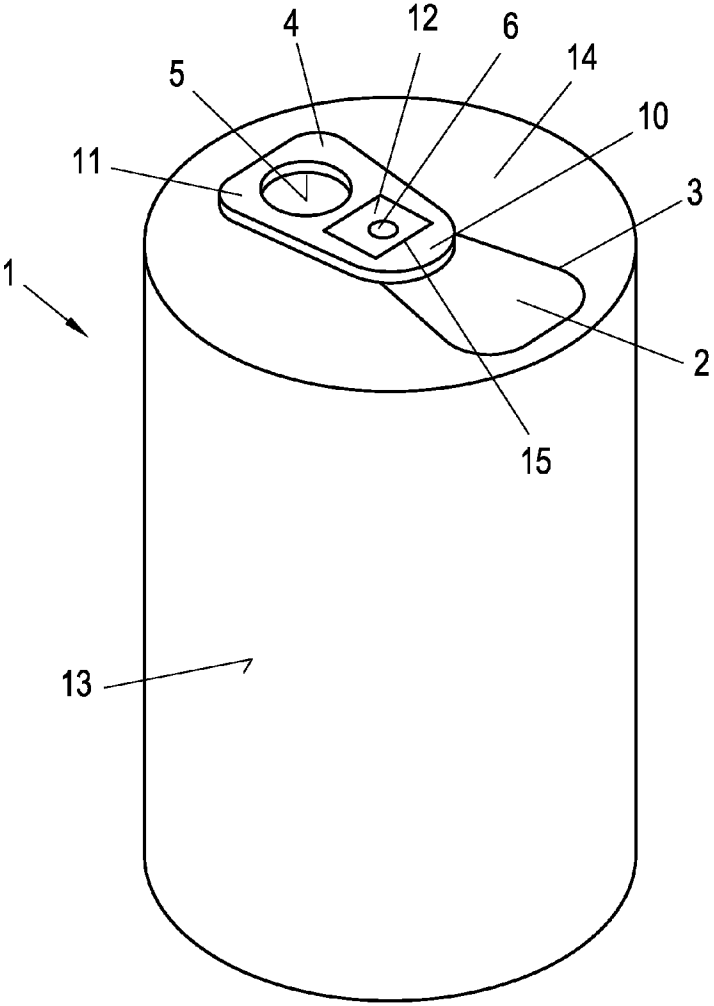
FIG. 1 shows a first embodiment of the invention in the initial position.

FIG. 1 shows a cylindrical can 1 according to the first embodiment of the invention. The body of the can 1 completely consists of aluminum, wherein the can 1 can have a printed, decorative foil on its jacket surface 13. A sealing area 2 is provided on the front wall 14 of the can 1, which is demarcated by a predetermined breaking edge 3. In addition, the can 1 has an opening element 4, which is connected to the front wall 14 of the can 1 via a rivet passing through the recess 16 (FIG. 3) of the opening element 4. The opening element 4 has a connecting element 12 with the recess 16 pivotable with regard to its body, which is connected via rivet 6 to the front wall 14 of the can 1, is arranged in parallel with the front wall 14, and which in particular rests flatly against the front wall 14 of the can 1. Usually the opening element 4 can be pivoted around the rivet axis of the rivet 6, and in the present exemplary embodiment there is no connection of the opening element 4 to the can 1 that is rigid against movement. The opening element flatly rests against the front wall 14 of the can 1.

Figure 2:
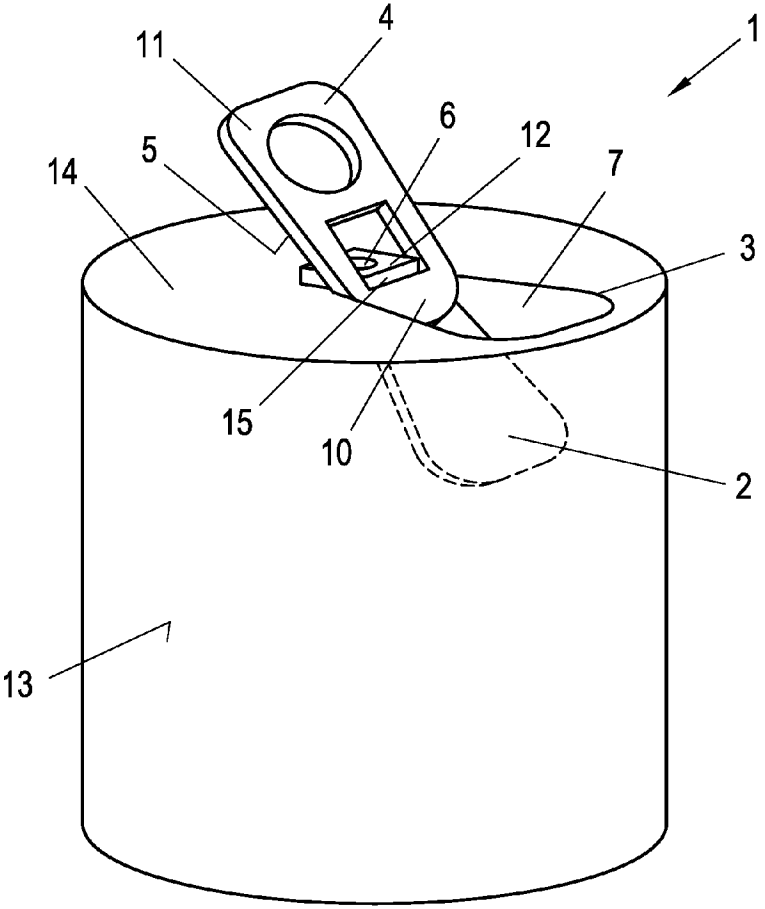
FIG. 2 shows the embodiment of the invention from FIG. 1 in the open position.

FIG. 2 shows the embodiment of the can 1 shown in FIG. 1 in the open position. During opening, an actuation area 11 of the opening element 4 facing away from the sealing area 2 is lifted, and the entire opening element 4 is pivoted with regard to a pivoting edge 15 located between the connecting element 12 and the body of the opening element 4. Thus, the pressing area 10 of the opening element 4 resting against the sealing area 2 is pressed towards the sealing area 2 into the interior of the can 1, so that the sealing area 2 rips along the predetermined breaking edge 3 of the front wall 14 of the can 1 and enters into the can 1. Thus, an opening 7 is created via which the can 1 can be emptied.

Figure 4:
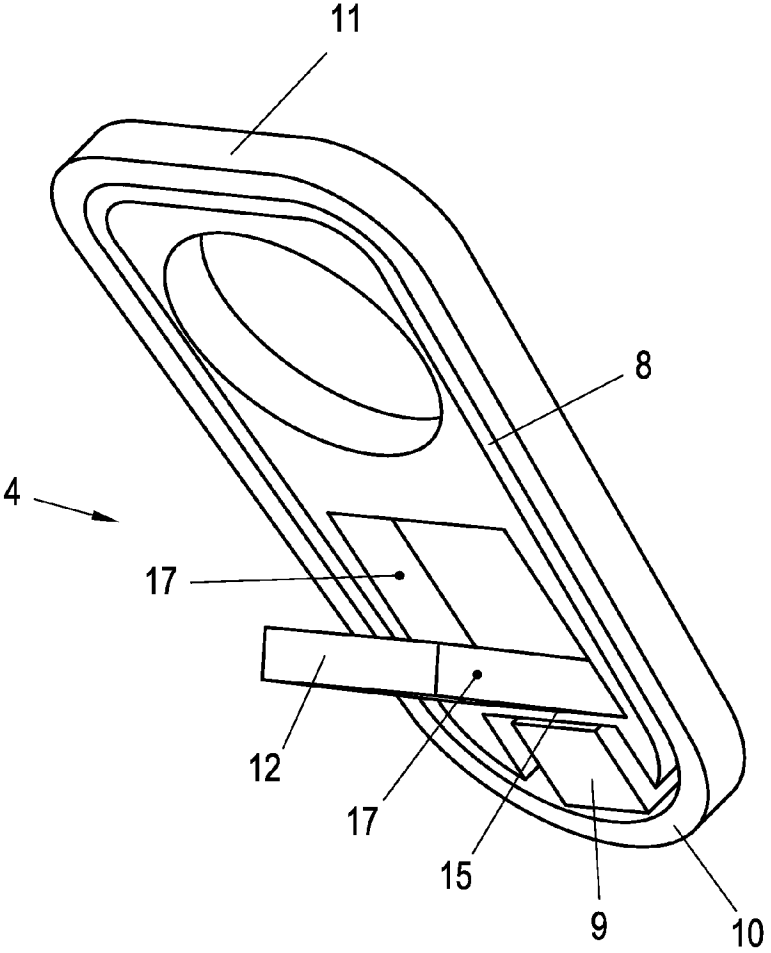
FIG. 4 shows the opening element of the embodiment of the invention shown in FIG. 1 in the open position obliquely from the side.

FIG. 4 shows the opening element 4 in detail. The opening element 4 shows a carrier body made of electrically and magnetically insulating material, wherein a recess is provided on the side of the opening element 4 facing the front wall 14, which runs in the form of a closed ring within the opening element 4. The wire windings of the antenna 8 run in this recess, which antenna is connected to a transponder chip 9 located in the pressing area 10 of the opening element 4. The antenna 8 runs along the edge of the lower front area of the opening element 4, which faces the front wall 14 of the can 1.

Figure 3:
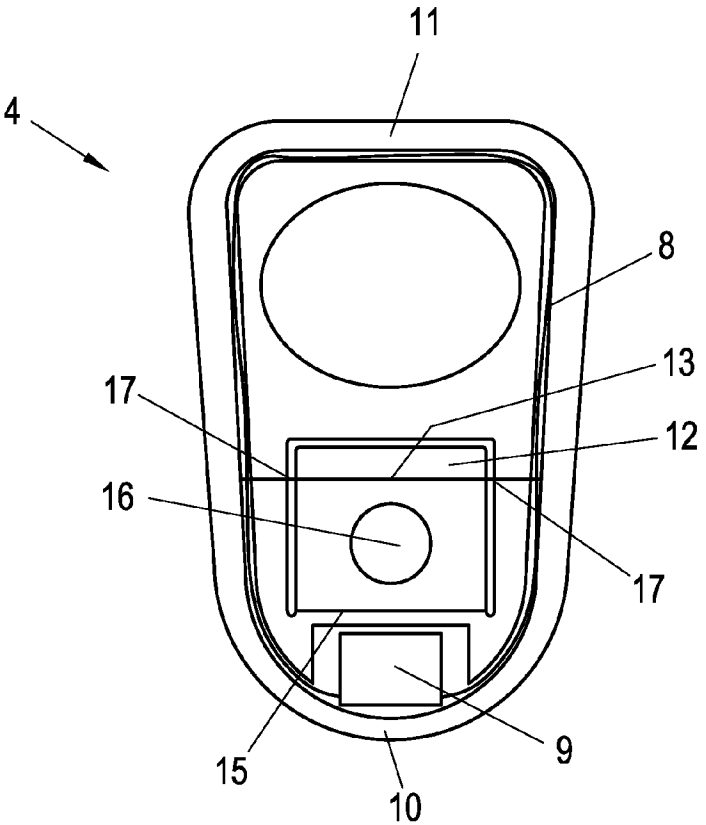
FIG. 3 shows the opening element of the embodiment of the invention shown in FIG. 1 in the initial position from above.

Furthermore, FIG. 3 shows a connection line 13, which short-circuits the two terminals of antenna 8. As long as can 1 is not opened and in the initial position, and the connection line 13 is intact, the two terminals of antenna 8 are connected to each other in an electrically conducting fashion and short-circuited. The electric connection line 13 is arranged in a way that it is irreversibly interrupted when the can 1 is opened by pivoting the opening element 4 from the initial position to the open position, which activates antenna 8.

In the embodiment shown herein this is achieved by connecting the connection line 13 to the transponder chip 9, wherein each of the two ends of the connection line 13 is respectively connected to one of the terminals of antenna 8 connected to the transponder chip 9. The connection line 13, the transponder chip 9 and the antenna 8 are connected in parallel. The connection line 13 runs within the body of the opening element 4 and leaves the body in the area of the connecting element 12. In the present embodiment, the connection line 13 runs within the connecting element 12 and finally in the opposite part of the body of the opening element 4 back to the transponder chip 9. In the intermediate area between the body of the opening element 4 and the connecting element 12, the connection line 13 has predetermined breaking points 17. FIG. 4 shows the opening element 4 in the opened position, wherein the predetermined breaking points 17 are visible from the side at which the connection line 13 has ripped. The predetermined breaking points 17 are located in the areas of the connecting element 12 and the opening element 4 that are moved with regard to each other by pivoting the opening element 4 into the open position and moved away from each other. The predetermined breaking points 17 are arranged at the end area of the connecting element 12 opposite the pressing area 10 as well as the pivoting edge 15, since this end area covers the largest possible distance during pivoting into the open position because of the leverage relationships of the opening element 4.

Figure 6:
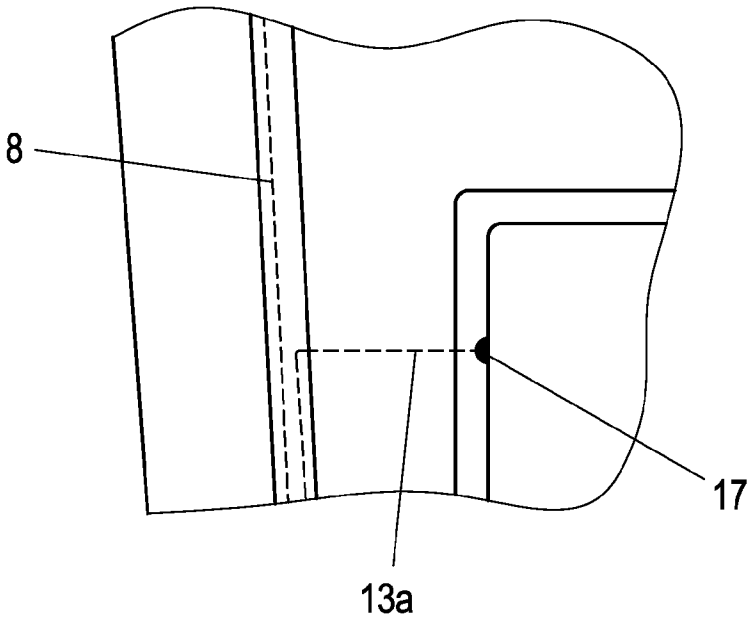
FIG. 6 shows a detail of FIG. 5.
Figure 5:
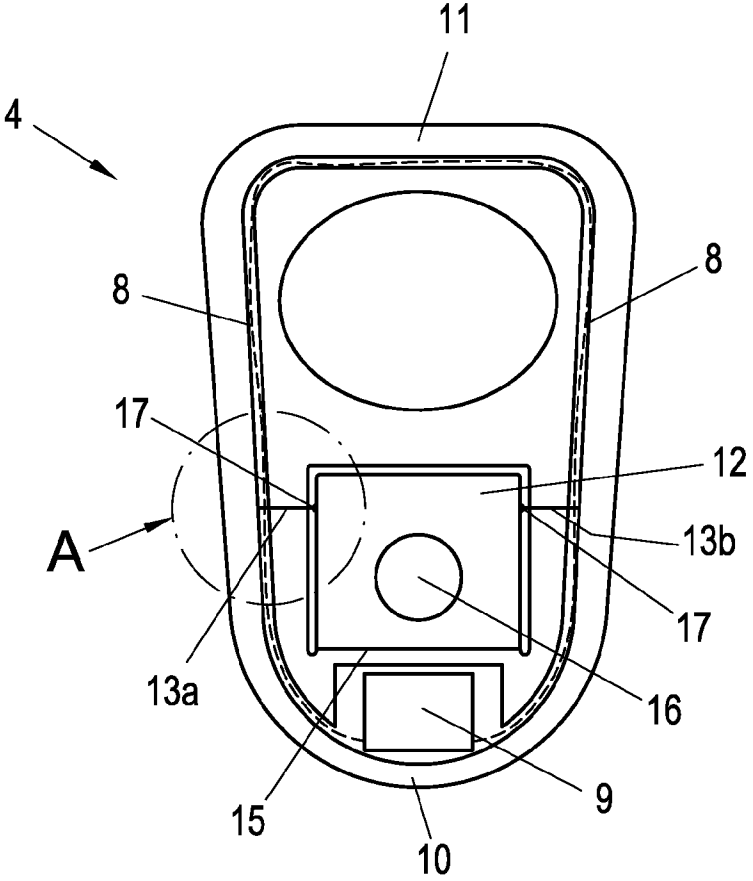
FIG. 5 shows an opening element according to a second embodiment of the invention in the initial position from above.

In the second embodiment of the invention, the connection line 13, as shown in FIG. 5, is also arranged in a way that it rips when the opening element 4 is pivoted into the open position, which activates the antenna 8 or terminates its short-circuiting. As shown in FIG. 5, the connecting part 12 is conducting, wherein the connecting part 12 serves as part of the connection line 13. The other parts 13*a*, 13*b* of the connection line 13 are each connected with the connecting part 12 in an electrically conducting fashion via predetermined breaking points 17. FIG. 6 shows the area A (FIG. 5) of the predetermined breaking points 17 in detail.

Figure 7:
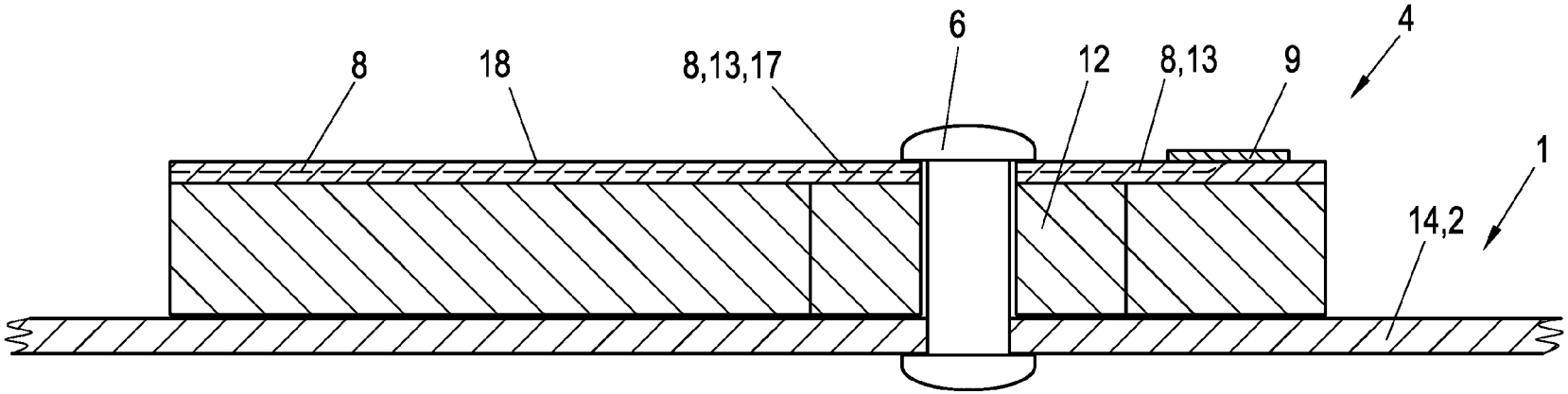
FIG. 7 shows a third embodiment of the invention in the initial position in a cross-sectional view.
Figure 8:
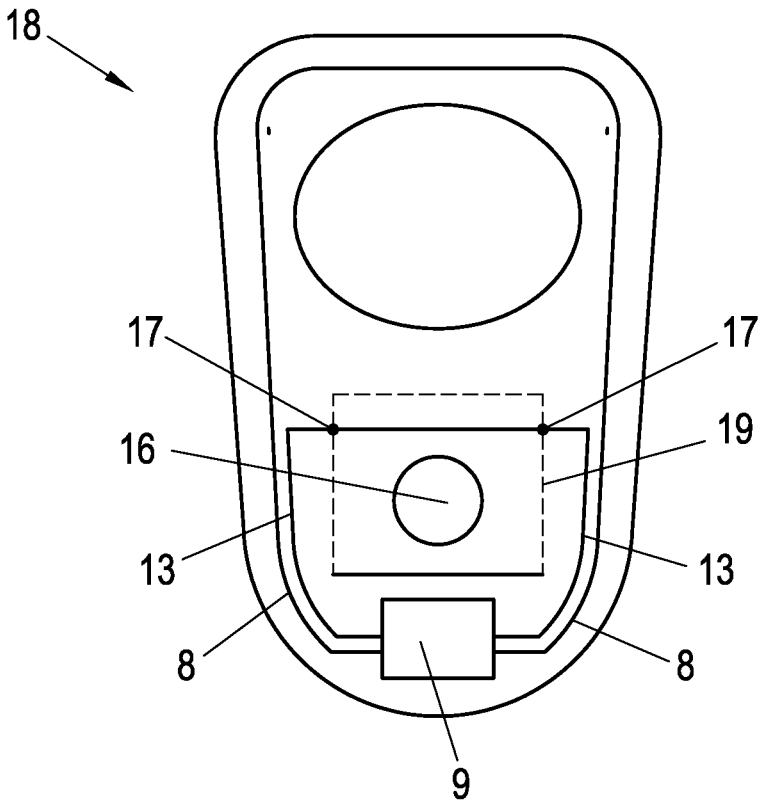
FIG. 8 shows an adhesive label that is used in the third embodiment of the invention.

In a third embodiment of the invention, which is shown in FIG. 7, all electromagnetically active components, i.e. antenna 8, transponder chip 9 as well as connection line 13 including the predetermined breaking points 17, are arranged together on a foil 18 in the form of an adhesive label 18, wherein the adhesive label 18 is adhered to the opening element 14. The electric connection line 13 can be arranged within or on the adhesive label 18. The connection line 13 and the foil 18 are partly arranged on the opening element 4 and partly on the connecting element 12. The adhesive label 18, which is shown from above in FIG. 8, has in the area between the connecting element 12 and the body of the opening element 4, in particular at the predetermined breaking points 17, a perforated edge 19, which rips when the opening element 4 is pivoted and also allows for ripping of the connection line 13 at the predetermined breaking points 17.

Figure 10:
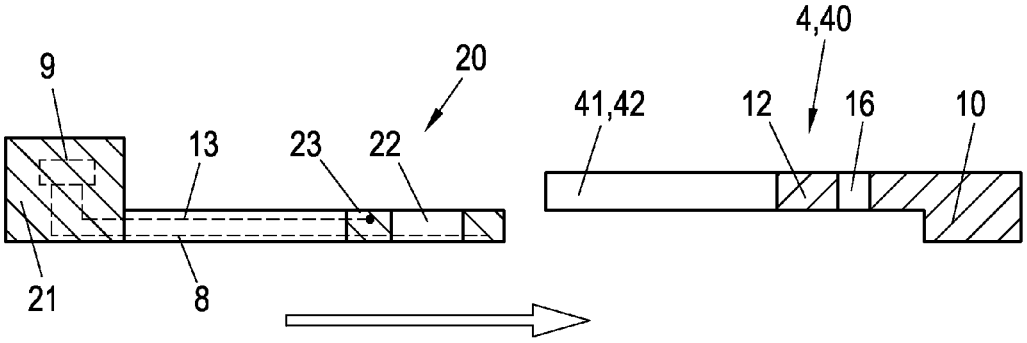
FIG. 10 shows two parts from which the opening element of the fourth embodiment of the invention is built in a cross-sectional view.

FIGS. 9 to 14 show a fourth embodiment of the invention. In this embodiment of the invention, the opening element 4 has, as shown in FIG. 10, 11, two parts and comprises a first antenna part 20 made of a non-conducting material and a second basic part 40 made of a conducting material. The antenna part 20 is in particular made of polyethylene. The antenna part 20 comprises a first housing part 21, in which the NFC Transponder chip 9 is embedded or cast. In addition, the antenna part 20 comprises an annular extension 22, which projects from housing part 21 and forms an annular body together with the housing part 21. In the interior of the annular body, antenna 8 is arranged. The two ends of antenna 8 are connected to the NFC transponder chip 9.

Figure 12:
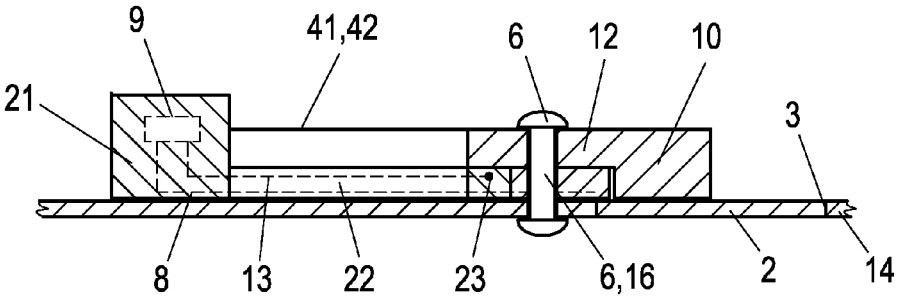
FIG. 12 shows a cross-sectional view of the fourth embodiment of the invention in the initial position.

The basic part 40 and the antenna part 20 correspond, as shown in FIG. 12, to the opening element 4 shown in FIGS. 3 and 4, with the difference that instead of the closed course, two locking extension 41, 42 project into the direction of the antenna part. These two locking extensions 41, 42 rest against an annular extension 22 projecting formed by the antenna part 20. The two front end areas of the locking extensions 41, 42 engage into openings provided in the housing part 21 of the antenna part 20, which creates a connection between the antenna part 20 and the basic part 40 that cannot be separated non-destructively.

Figure 11:
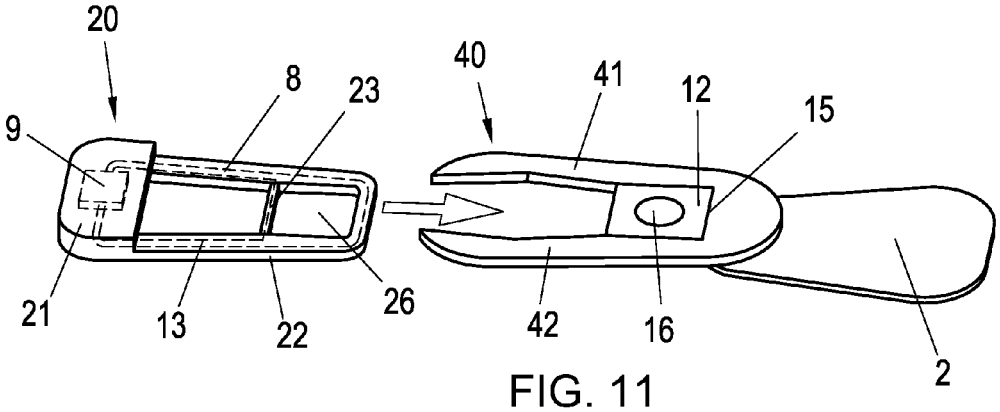
FIG. 11 shows the two parts in an oblique view.

As shown FIG. 11, the antenna part 20 has a bridge 23, which connects the two parts of the antenna part 20 resting against the locking extensions 41, 21. The connection line 13 runs in the interior of the antenna part 20, wherein the two ends of the connection line 13 are each connected to one of the terminals of the antenna 8 and the transponder chip 9. As long as the connection line 13 is intact, the antenna 8 as well as the transponder chip 9 are short-circuited by the connection line 13, so that data communication between an external data communication device via the antenna 8 with the transponder chip 9 is impossible. The connection line 13 runs partly within the bridge 23. The bridge 23 divides the annular extension 22 formed by the antenna part 20 into two separate rings separated from each other, so that a front recess 26 is formed. This recess 26 is located within the area of the recess 16 of the connecting part 12, and as shown in FIG. 12, the rivet 6 runs therethrough. In the specific arrangement of the basic part and/or with regard to the antenna part 20 and the formation of the opening element 4 caused thereby, the bridge 23 comes to rest below the connecting element 12. If the opening element 4 is pivoted from the initial position to the open position, the bridge 23 is kept back by the connecting element 12 and ripped off due to the leverage forces acting on the bridge via the connecting element 12 after pivoting into the open position. Thus, the connection line 13 running within the bridge 23 is also disconnected, so that the antenna 8 so far short-circuited, and the transponder chip 9 so far short-circuited are now functional and can establish data communication with an external data communication device.

Figure 15:
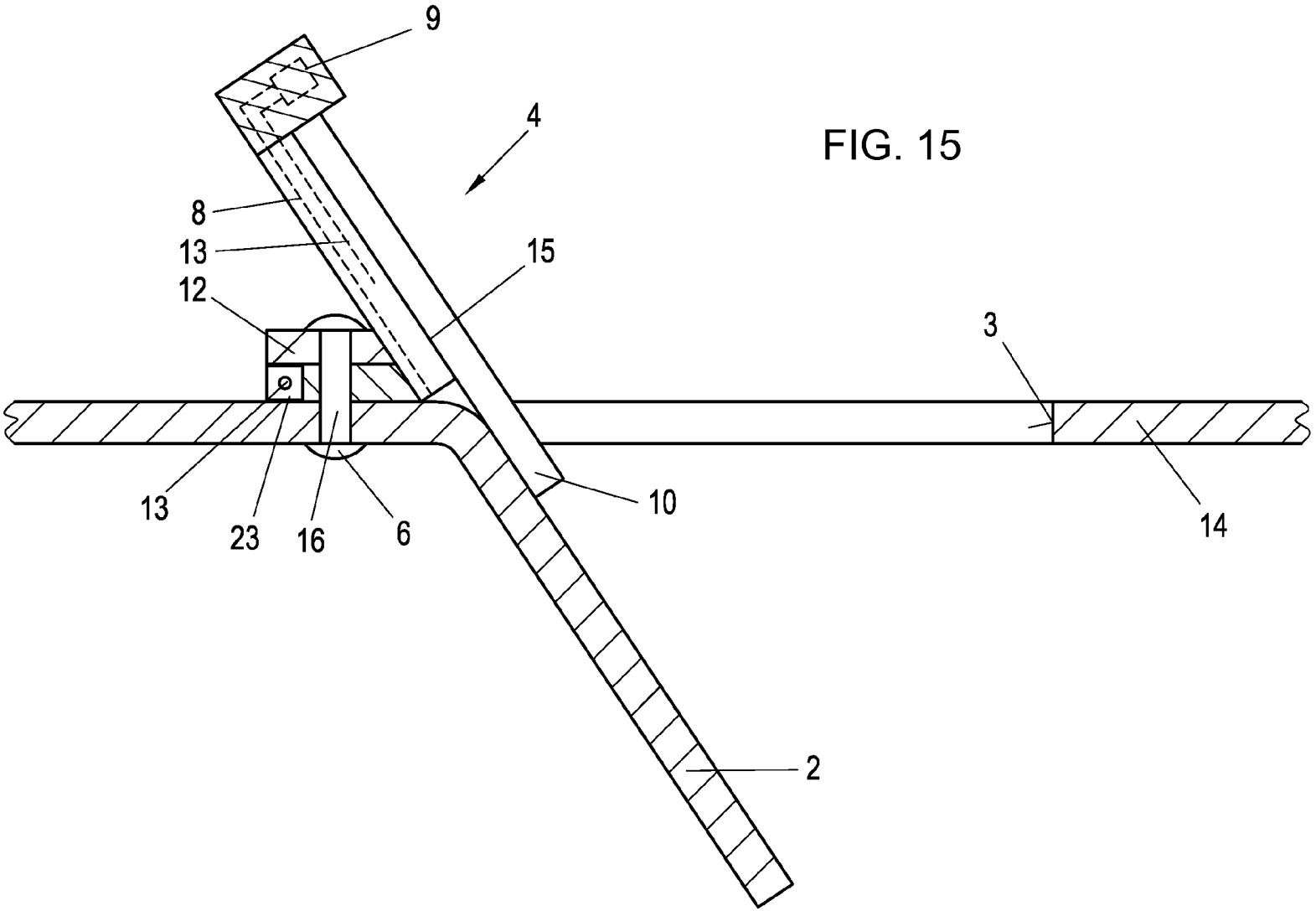
FIG. 15 shows the front wall of the can as well as the opening element in the open position in a cross-sectional view.

In FIG. 15 shows the front wall 14 of the can as well as the opening element 4 in the open position. By pivoting the opening element 4, the extension 10 of the opening element 4 presses against the sealing area 2 of the can 1 and presses it inward, so that an opening in the front wall 14 of the can 1 is formed. By pivoting the opening element 4 with regard to the front wall 14 of the can 1, the connecting element 12 is bent at the edge 15, and the basic part and the antenna part are pivoted around the edge 15. Since the bridge 23 is kept back by the connecting part 12, the bridge 23 comes off at the two ends, which also disconnects the connection line 13 running within the bridge.

The particular constructional design of the opening element 4 additionally achieves that the opening element 4 itself does not shield or displace any electromagnetic waves, so that a particularly good radio connection between the transponder 9 via the antenna 8 to an external data communication device can be established in the open state.

Generally, cans 1 are manufactured completely of aluminum or another metal. In order to allow for additional field displacement in addition to the inventive effect, it may be provided that the wall and surface area 5 of the can 1 against which the opening element 4 rests is electrically and/or magnetically conducting. This is of particular advantage if the connection line 13 is separated due to production or transport reasons and electromagnetic communication via the antenna 8 would be possible. In the present exemplary embodiment, the wall or surface area 5 of the can 1 against which the opening element 4 rests has electric conductivity of at least $10^6$ S/m, in particular of at least 10 S/m auf. In addition, the can 1 has, in the wall and surface area 5 against which the opening element 4 rests, a magnetic permeability of at least $4*\pi*10^{-7}$ Vs/Am, in particular of at least $0.99*4*\pi*10^{-7}$ Vs/Am. Aluminum, which is typically used as material for the wall and/or surface area of the can 1, in particular for the entire can 1, has electric conductivity of $37*10^6$ S/m and a magnetic permeability of $(1+2.2*10^{-5})*4*\pi*10^{-7}$ Vs/Am.

Typically, frequencies of 13.56 MHz are used for transmission. Of course, another transmission frequency may be used alternatively, for example of 120-135 kHz or a transmission frequency of 860-910 MHz.

The invention claimed is:

1. A can, comprising:

a body having a front wall;

a sealing area at least partially demarcated on said front wall by a predetermined breaking edge;

an opening element having an initial position, an open position and a connecting element, said opening element, in said initial position, resting at least partially against said front wall and being connected to said front wall at least at one point by said connecting element;

said opening element, upon pivoting relative to the can from said initial position to said open position, ripping said sealing area along said predetermined breaking edge and forming an opening for emptying contents of the can in an intermediate area demarcated by said predetermined breaking edge;

said opening element including a carrier body having or being formed of at least one of an electrically or magnetically insulating material;

said opening element carrying an antenna disposed on or within said carrier body and a transponder chip connected to said antenna, said antenna having two terminals;

an electric connection line electrically conductively interconnecting and short-circuiting said two terminals of said antenna in said initial position of said opening element; and said electric connection line being irreversibly disconnected and activating said antenna upon opening the can by pivoting said opening element from said initial position to said open position.

2. The can according to claim 1, wherein said body is formed of aluminum and said connecting element is connected to said front wall.

3. The can according to claim 1, wherein said electric connection line is disposed partly within or on said connecting element and partly within or on said opening element, and said connection line rips when said opening element is pivoted relative to said connecting element.

4. The can according to claim 1, wherein said electric connection line has a predetermined breaking point in at least an intermediate area between said connecting element and said opening element, and said predetermined breaking point rips when said opening element is pivoted with relative to said connecting element.

5. The can according to claim 1, which further comprises a foil disposed on said opening element, said antenna and said transponder chip being disposed in common on said foil.

6. The can according to claim 5, wherein said foil is an adhesive label adhered to said opening element.

7. The can according to claim 5, wherein said electric connection line is disposed within or on said foil and said electric connection line and said foil are disposed partly on said opening element and partly on said connecting element.

8. The can according to claim 1, wherein at least one of said connecting element or said opening element have a body with an electrically conducting part, and said electric connection line is formed by said electrically conducting part of said body of at least one of said connecting element or said opening element.

9. The can according to claim 1, wherein said connecting element is connected to said front wall of the can by forming said connecting element flatly and fixing or running said connecting element within a plane parallel to said front wall.

10. The can according to claim 1, wherein said connecting element is disposed rotatably around an axis perpendicular to a plane of said front wall.

11. The can according to claim 1, wherein:

said opening element has a carrier material; and at a transmission frequency of said transponder chip between 100 kHz and 1000 MHz, or between 120-135 kHz, or between 13-14 MHz or between 860-910 MHz, said carrier material has at least one of:

a specific electric conductivity lower than 1 S/m, or an electric permittivity lower than $100*8.854*10^{-12}$ As/Vm, or a magnetic permeability lower than $1.001*4*\pi*10^{-7}$ Vs/Am.

12. The can according to claim 1, wherein said sealing area and said predetermined breaking edge are formed on said front wall.

13. The can according to claim 1, which further comprises a rivet connecting said opening element to said front wall, said opening element having a pressing area resting against said sealing area in said initial position for pressing-in said sealing area.

14. The can according to claim 13, wherein said opening element has an actuation area opposite said pressing area, and said pressing area and said actuation area are separated from each other by said rivet and together act as a two-armed lever pivoting at said rivet.

15. The can according to claim 10, wherein said connecting element of said opening element has a body being pivotable and connected to said front wall by said rivet.

16. The can according to claim 1, wherein said transponder chip, in said initial position of said opening element, is disposed in an area of said opening element resting against said sealing area.

17. The can according to claim 1, wherein said antenna is formed annularly.

18. The can according to claim 17, wherein said antenna is disposed along a circumferential edge of said opening element in a recess.

19. The can according to claim 1, wherein:

said opening element is formed of a basic part pivoting on said front wall and an electrically non-conducting antenna part connected to said basic part;

said transponder chip and said antenna are disposed or cast in said antenna part; and said basic part has one or two extensions connected to said antenna part.

20. The can according to claim 19, wherein said antenna part has a housing part and an annular extension, and said antenna runs at least partly within said annular extension.

21. The can according to claim 19, wherein said antenna part has a housing part and an annular extension, and said housing part has one or two locking recesses in which an end of said one or two extensions of said basic part engage or are locked.

22. The can according to claim 19, wherein said antenna part has a housing part and an annular extension, and said one or two extensions of said basic part rest against said annular extension for said antenna part.

23. The can according to claim 19, which further comprises:

a rivet connecting said opening element to said front wall;

said antenna part having a housing part and an annular extension with first and second parts;

said antenna part having a bridge in the vicinity of said annular extension connecting said first part of said annular extension with said second part of said annular extension and forming two recesses;

said rivet running through one of said recesses; and said bridge in said initial position of said opening element being disposed below said connecting part and ripping upon said opening element being actuated.

* * * * *